United States Patent [19]

Shinohara et al.

[11] Patent Number: 4,990,730

[45] Date of Patent: Feb. 5, 1991

[54] ILLUMINATED PUSH-BUTTON SWITCH

[75] Inventors: Kenji Shinohara, Osaka; Takashi Niwa, Kyoto, both of Japan

[73] Assignee: Omron Tateisi Electronics Co., Kyoto, Japan

[21] Appl. No.: 375,887

[22] Filed: Jul. 6, 1989

[30] Foreign Application Priority Data

Mar. 20, 1987 [JP] Japan ..... 62-67185
Mar. 23, 1987 [JP] Japan ..... 62-69540
Apr. 2, 1987 [JP] Japan ..... 62-50360

[51] Int. Cl.[5] ..... H01H 9/16
[52] U.S. Cl. ..... 200/314
[58] Field of Search ..... 200/314, 293, 517

[56] References Cited

U.S. PATENT DOCUMENTS 4,268,735 5/1981 Iwakiri ..... 200/314
4,342,885 8/1982 Kashima et al. ..... 200/293 X
4,453,062 6/1984 Brown et al. ..... 200/332 X
4,479,040 10/1984 Denley et al. ..... 200/517
4,692,572 9/1987 Heath ..... 200/67 A X
4,751,385 6/1988 Van Benthusysen ..... 200/314

FOREIGN PATENT DOCUMENTS 122642 10/1984 European Pat. Off. ..... 200/314

*Primary Examiner*—Renee S. Luebke
*Attorney, Agent, or Firm*—Fish & Richardson

[57] ABSTRACT

Herein disclosed is an illuminated push-button switch structure in which, when the push button is pushed, the push-button guide member united to the button is depressed while being supported to slide by the switch base. Then, the switch lever of the switch mechanism associated with the push-buton guide member is abruptly turned back with a predetermined depression stroke to afford a switching feel. This turn prevents further movement of the push button in a predetermined depression direction in order to eliminate any undesired vibration of the push button. Even if the push button is obliquely pushed, it is always prevented from being inclined to provide the stable switching operation at all times.

2 Claims, 4 Drawing Sheets

ILLUMINATED PUSH-BUTTON SWITCH

This application is a continuation of U.S. application Ser. No. 169,907, filed Mar. 18, 1988, now abandoned.

REFERENCE TO RELATED APPLICATION

This application is related to commonly-assigned application Ser. No. 07/177,355.

BACKGROUND OF THE INVENTION

1. Field of the Invention

The present invention relates to an illuminated push-button switch, a plurality of which are arranged in a line on the front side of, for example, an automatic ticket machine to be used in a railway station, for example, so that it may be switched to vend railway tickets.

2. Discussion of the Related Art

FIG. 7 shows one of the illuminated push-button switches of the prior art, which is furnished with an indicator function to indicate a switched input signal and a piece of input information. In FIG. 7, in the top of a box-shaped housing formed by the combination of a switch case 71 and a switch base 72, there is fitted a push button 73 that protrudes from the switch case and can be pushed. The push button 73 depresses, when pushed, the actuator 76 of switch 75 through a depression member 74 which is associated with the movement of the push button 73. Then, the switch 75 is turned on, and this ON signal is indicated through illumination of an indicator 77. In FIG. 7, reference numerals 78 and 79 designate an input/output wiring flexible substrate and a return spring for the depression member 74, respectively.

In this structure, the depression member 74 interposed between the upper push button 73 and the lower switch 75 is biased upwardly by the return spring 79 to contact the upper push button 73. This structure causes the return spring 79 to rock, while being extended or contracted, and vibrates the mating portions of the push button 73 and the depression member 74. This vibration often inhibits the smooth depression of the push button 73. In the worst case, the switch 75 fails to operate when the push button 73 is obliquely pushed.

The structure also suffers from low reliability. In addition, it is impossible to reliably attain the operational feel or confirmation when the switch 75 is turned on or off, even if the depression member 74 is depressed against the biasing force of the return spring 79.

Moreover, the switch case 71 is formed with several fitting holes (although not shown) for assembling the switch components. This structure suffers from another problem in that external dust or interfering light often enters the switch case 71 via those fitting holes to degrade the switching performance.

SUMMARY OF THE INVENTION

It is, therefore, an object of the present invention to provide an illuminated push-button switch for preventing the push button from vibrating when pushed.

Another object of the present invention is to provide an illuminated push-button switch which is furnished with an excellent operational feel when pushed.

Still another object of the present invention is to provide an illuminated push-button switch which is substantially dust-free.

A further object of the present invention is to provide an illuminated push-button switch which has a high switching performance.

According to the present invention, there is provided an illuminated push-button switch structure comprising: a push button mounted in the front side of a machine; a pushbutton guide member for guiding the depression of said push button in a predetermined direction; a switch mechanism including switch levers adapted to be turned to inclined positions to give a switching feel; a switch adapted to be operated by said switch mechanism; an indicator for indicating the switch input information of said switch through illumination; a stationary substrate mounting said indicator and said switch thereon; a switch base supporting not only said push-button guide member slidably but also said switch mechanism and said stationary substrate; and a switch case accommodating said switch base.

BRIEF DESCRIPTION OF THE DRAWINGS

The above and other objects, advantages and features of the present invention will be more fully understood when considered in conjunction with the following figures, of which:

FIG. is an exploded perspective view showing an illuminated push-button switch according to one embodiment of the present invention;

FIG. 6 is a longitudinally sectional side elevation showing the illuminated push-button switch when turned on.

DETAILED DESCRIPTION OF THE INVENTION

Figure 1:
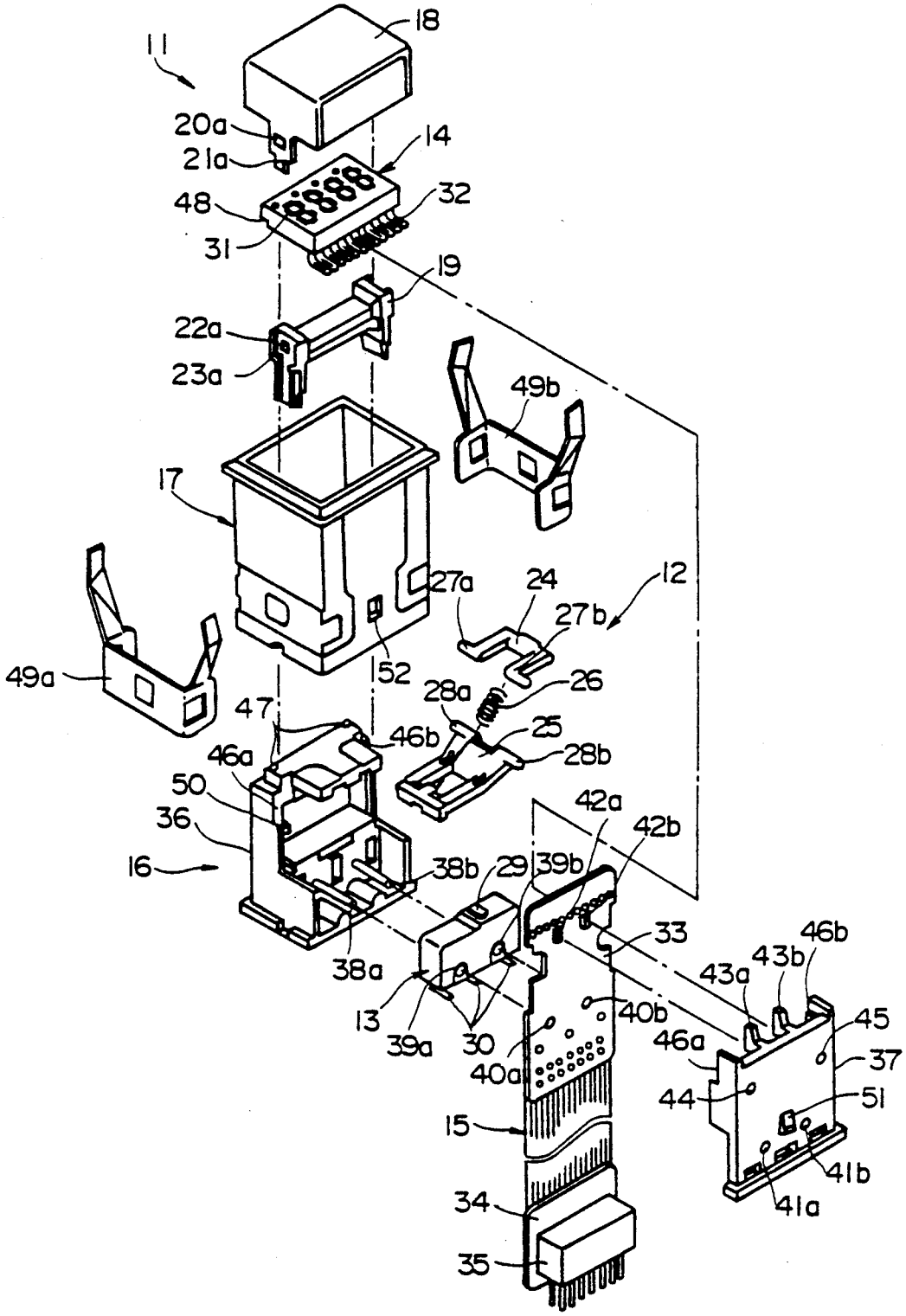
Figure 2:
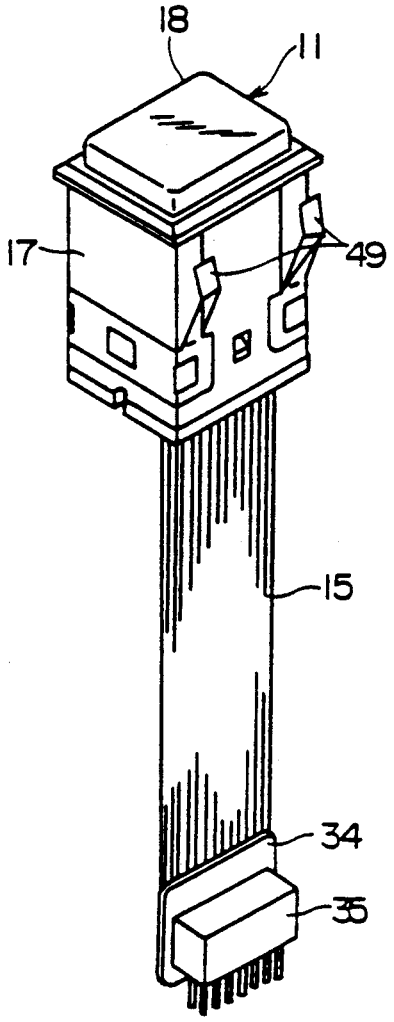
FIG. 2 is a perspective view showing the exterior of the illuminated push-button switch.
Figure 3:
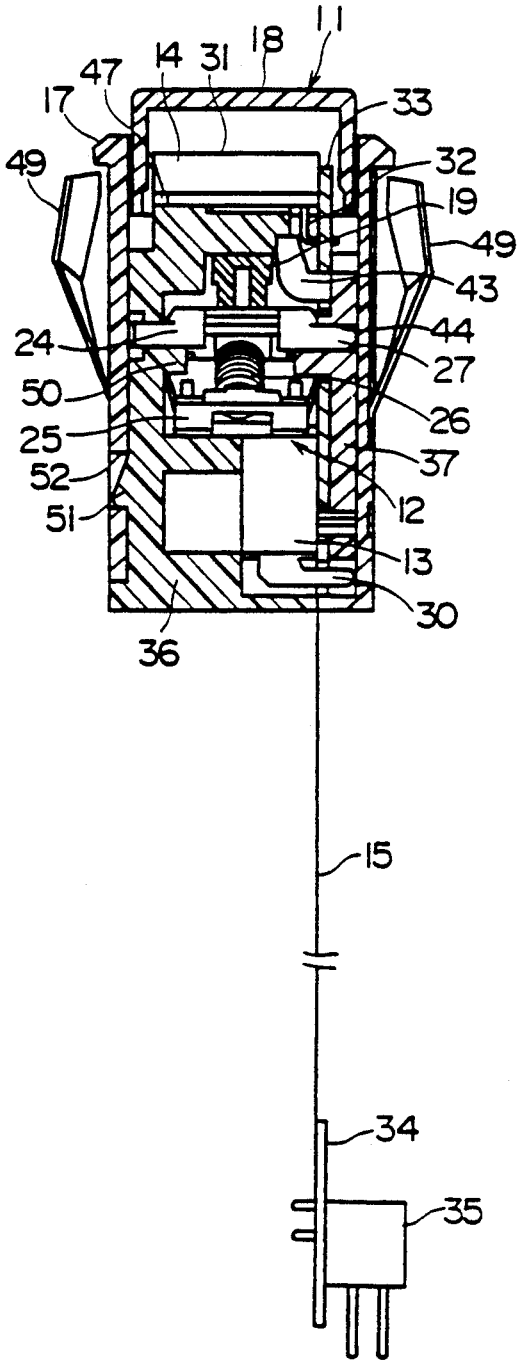
FIG. 3 is a longitudinally sectional front elevation showing the illuminated push-button switch.
Figure 4:
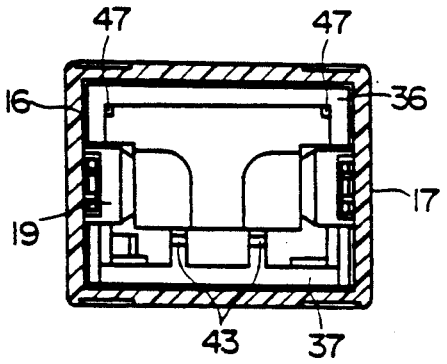
FIG. 4 is a transversely sectional top plan view showing the illuminated push-button switch.

FIGS. 1 to 6 show the illuminated push-button switch according to a preferred embodiment of the present invention. This illuminated push-button switch is constructed of a push-button unit 11, a switch mechanism 12, a micro-switch 13, an indicator 14, a flexible substrate 15, a switch base unit 16 and a switch case 17. The push-button unit 11 is equipped with a push button 18, and a push-button guide member 19 for guiding the depression direction of the push button 18. This push button 18 is preferably made of a resin into a box shape having its lower side open. This box has a transparent upper side providing a depression surface and accommodates the indicator 14, as will be described in detail, in its lower space. From the two side walls of the push button 18, there depend stepped legs which are formed with engagement holes at their central portions (although only hole 20*a* and leg 21*a* are shown). These paired stepped legs 21*a* and 21*b* are fixed to the push-button guide member 19, which will also be described in detail.

The push-button guide member 19 is generally C-shaped to provide two legs having their outer sides formed with both engagement projections (although only one is shown and designated at 22*a*) corresponding to the engagement holes 20*a* and 20*b* and stepped retaining portions (although only one is also shown and designated at 23*a*) corresponding to the stepped legs 21*a* and 21*b*. After engagement of these portions, the push-button guide member 19 and the push button 18 are fixed to each other. The push-button guide member 19 thus assembled has its central portion opposed to the switch mechanism 12 disposed therebelow.

This switch mechanism 12 is composed of a first lever 24, a second lever 25 and a lever return spring 26. The first lever 24 is also formed generally into the shape of letter "C" to form legs which are bent outward at a right angle to form first pivots 27*a* and 27*b*. The first lever 24 has its pivots 27*a* and 27*b* borne by the switch base unit 16, as will be described in detail, and its central bridge portion opposed to the push-button guide member 19.

On the other hand, the second lever 25 is bent to have its upper edge projected sideways to form second pivots 28*a* and 28*b*, which are supported by the switch base unit 16. The bent central portion of the second lever 25 is disposed to push an actuator 29 of the micro-switch 13, as will also be described in detail. The lever return spring 26 has a coil shape and is sandwiched under compression between the inner face of the central portion of the lower edge of the second lever 25 and the inner face of the central portion of the aforementioned first lever 24. Thus, the first lever 24 is biased to an upwardly inclined position on the pivots to urge the push-button guide member 19 and the push button 18 to upper positions. On the other hand, the second lever 25 positioned below is biased by the lever return spring 26 to bring the underlying actuator 29 of the micro-switch 13 into an OFF state.

When the push button 18 is pushed, the first lever 24 is depressed through the push-button guide member 19 so that the lever return spring 26 is gradually compressed to increase its biasing force. At a predetermined position, the second lever 25 is abruptly turned back upward on the pivots to the inclined position. Then, the second lever 25 leaves the actuator 29 to allow the actuator 29 to move upwardly in the ON state.

The micro-switch 13 is equipped on its upper side with the actuator 29, which is disposed to move to and from the second lever 25. Extending from the lower side of the micro-switch 13 is external terminals 30, through which it is mounted on the flexible substrate 15, as will be described in detail.

The indicator 14 is equipped on its upper side with an indication surface 31 having seven segments. This indication surface 31 is arranged in the lower space of the push button 18 to indicate the information inputted through illumination when in the switching operation. The indicator 14 is equipped on its lower side end with external terminals 32, through which it is mounted on the flexible substrate 15.

This flexible substrate 15 is formed into a tape shape having input/output wiring. To the one end of the flexible substrate 15, there is fixed a stationary substrate 33, on which the micro-switch 13 and the indicator 14 are mounted through the external terminals 30 and 32, respectively. On the other end of the flexible substrate 15 there is mounted an external wiring connector 35 through a connector substrate 34.

The aforementioned switch base unit 16 is comprised of a first base 36 and a second base 37. These two bases 36 and 37 are combined into a box shape. The two bases 36 and 37 are connected to fix the flexible substrate 15 by inserting a pair of switch holding pins 38*a* and 38*b*, which project from the side walls of the first base 36, into positioning holes 39*a* and 39*b* of the micro-switch 13, further substrate holes 40*a* and 40*b* of the stationary substrate 33, and fixing holes 41*a* and 41*b* of the second base 37, continuously in the recited order. Moreover, the two bases 36 and 37 are united by holding L-shaped engagement projections 43*a* and 43*b*, which project from the upper side walls of the second base 37, in engagement with a pair of engagement holes 42*a* and 42*b* which are formed in the upper portion of the flexible substrate 15.

Thus, the two bases 36 and 37 support in its internal space the switch mechanism 12 opposed to the micro-switch 13. This support is accomplished such that the two levers 24 and 25 are allowed to rock on their pivots by fitting the first and second pivots 27*b* and 28*b* of the two levers 24 and 25 of the switch mechanism 12 in first and second pivot holes 45 and 44. This supporting manner likewise applies to the first and second pivots 27*a* and 28*a*.

After assembly, the two bases 36 and 37 form vertical slide grooves 46*a* and 46*b* in their outer sides. In these slide grooves 46*a* and 46*b*, there are slidably fitted the stepped legs 21*a* and 21*b* of the push-button guide member 19, through which the direction of depression of the push button 18 in a predetermined direction is regulated, in order to eliminate any unexpected vibrations.

The first base 36 is formed at its upper end with retaining projections 47 for fixing the indicator 14. When the switch is assembled, these retaining projections 47 are held within retaining recesses 48, which are formed in the two corners of the lower side of the indicator 14, and act to hold the indicator 14 in position on the box-shaped unit 16. As a result of assembly, the box-shaped unit 16 is united. A switch case 17 fits over the switch base unit 16 to shield the openings formed in the bases 36 and 37. This shielding blocks invasion of dust and/or interfering ambient light so that the switching performance can be maintained in a stable state.

Around the switch case 17, moreover, there are fitted leaf springs 49*a* and 49*b* for mounting the illuminated pushbutton switch on the machine body.

In order to afford a sufficient switching stroke for the push button 18, the degree of inclination of the first lever of the switch mechanism 12 is set at a predetermined angle corresponding to the depression stroke. When the second lever 25 is turned back, it is stopped by a lever stopper 50 which projects from the first base 36.

In the drawings, reference numerals 51 and 52 designate a case fitting pawl and a fitting hole, respectively.

The operations of the illuminated push-button switch thus constructed will be described in the following.

Figure 5:
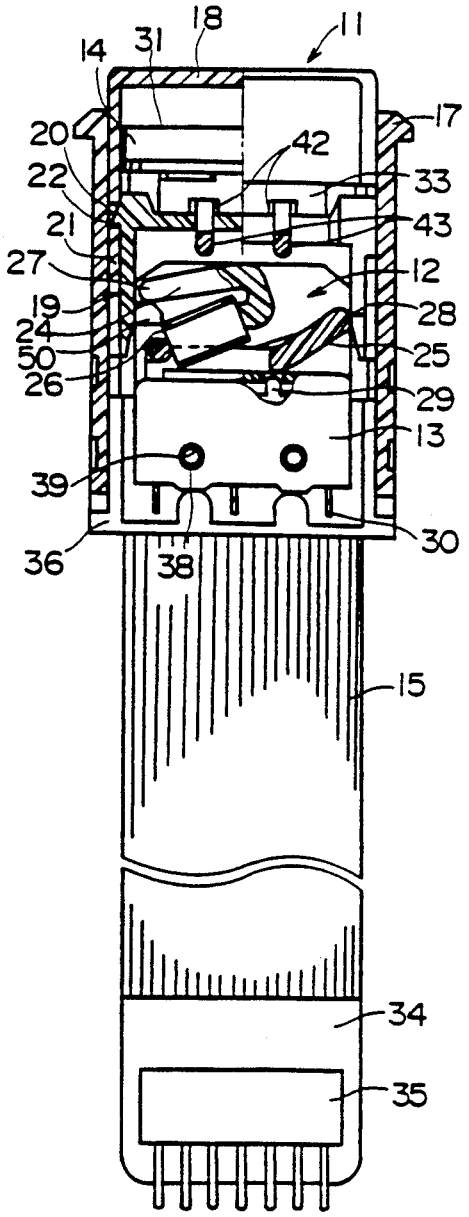
FIG. 5 is a longitudinally sectional side elevation showing the illuminated push-button switch when turned off.

As shown in FIG. 5, the push button 18 is normally in a depressible OFF state, in which it is biased by the lever return spring 26 disposed therein so as to protrude by a predetermined stroke from the upper surface of the switch case 17.

Figure 6:
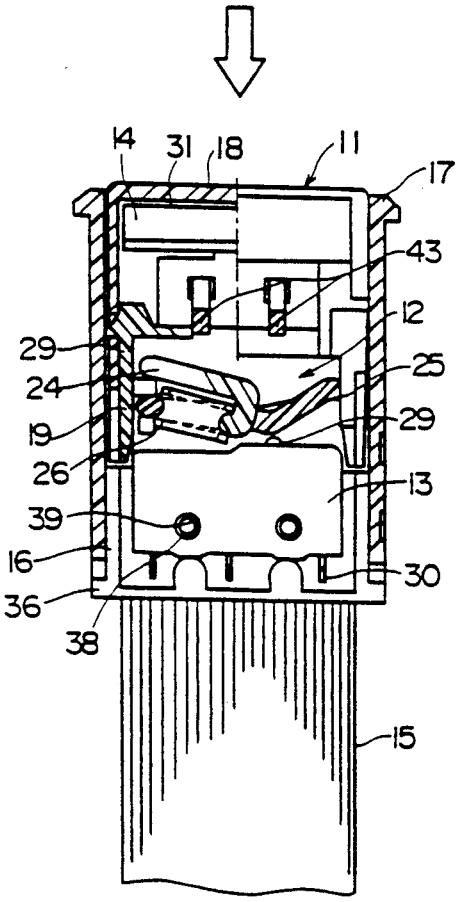
Figure 7:
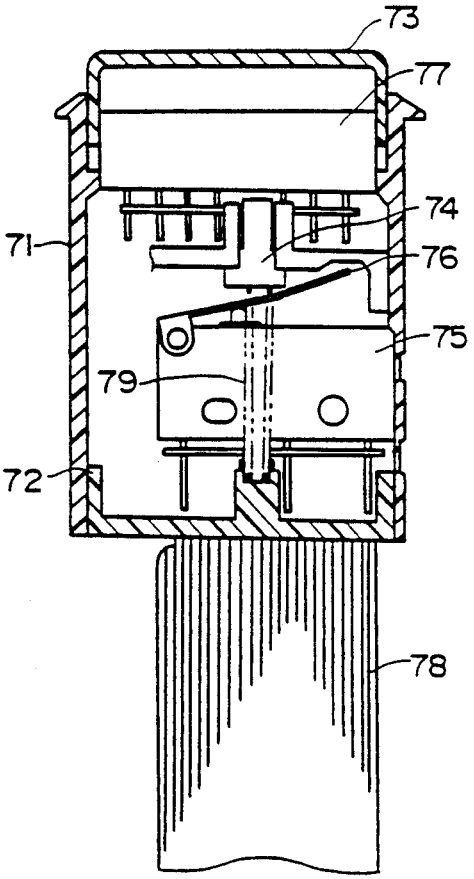
FIG. 7 PRIOR ART
FIG. 7 is a longitudinally sectional side elevation showing the illuminated push-button switch of the prior art.

When the push button 18 is depressed, the push-button guide member 19 is guided, as shown in FIGS. 5 and 6, to slide in the slide grooves 46*a* and 46*b* of the switch base unit 16. In response to this depression, the free end of the first lever 24 is depressed by the central portion of the push-button guide member 19. The lever return spring 26 absorbs this depression by a predetermined amount. When this depression load reaches a predetermined level, the free end of the second lever 25 is turned back upward by the spring 26. This establishes the excellent operation feel, which could not be attained by the switch of the prior art. In response to this turn, on the other hand, the second lever 25 leaves the actuator 29 to turn on the micro-switch 13 so that predetermined information is indicated by the indicator 14.

If the push button 18 is released from its depression, the switch mechanism 12 restores to its initial position so that it is prepared for a subsequent depression.

In the depression of the push button, as described above, the push-button guide member is depressed together with the button while being supported to slide by the two bases. In association with this push-button guide member, the levers of the switch mechanism are abruptly turned back with the predetermined depression to afford the switching feel.

This fixes the depression direction of the push button to eliminate the vibration of the push button. Further, the push button is prevented from being unexpectedly inclined, even if this button is obliquely pushed, so that the button can always be stably operated.

The above description and the accompanying drawings are merely illustrative of the application of the principle of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

We claim:

1. An illumination type push button switch, comprising a switch case, first and second split-type switch bases, a push button projecting from the switch case, and an inner switch element within the switch case which is switched by depressing the push button and a display unit for displaying input information by means of illumination of the push button, which further comprises an input/output flexible wiring board electrically connected to the inner switch element and the display unit; and a reinforcing fixing board which is fitted to a connection portion of the flexible board and which is supported by the first split-type switch base;

wherein the inner switch element and the display unit are mounted on the fixing board so as to be connected to the flexible board at their mounted positions.

wherein the first split-type switch base has formed thereon an engagement portion which engages a free end of the display unit and an engagement recess which engages with the second split-type switch base; and wherein the second split-type switch base has a wall surface opposing the first split-type switch base which is formed with a convex engagement portion which engages with the engagement recess on the first split-type switch base through the fixing board.

2. An illumination type push button switch, comprising a switch case, a push button projecting from the switch case, and an inner switch element within the switch case which is switched by depressing the push button and a display unit for displaying input information by means of illumination of the push button, which further comprises an input/output flexible wiring board electrically connected to the inner switch element and the display unit; and a reinforcing fixing board fitted to a connection portion of the flexible board;

wherein the inner switch element and the display unit are mounted on the fixing board so as to be connected to the flexible board at their mounted positions.

* * * * *